United States Patent [19]

Engle

[11] Patent Number: 4,718,800

[45] Date of Patent: Jan. 12, 1988

[54] STANCHION

[75] Inventor: Thomas H. Engle, Cape Vincent, N.Y.

[73] Assignee: General Signal Corporation, Stamford, Conn.

[21] Appl. No.: 853,561

[22] Filed: Apr. 18, 1986

[51] Int. Cl.[4] ..... B60P 7/13

[52] U.S. Cl. ..... 410/61

[58] Field of Search ..... 410/58-64; 105/29.1; 104/139, 140; 414/392, 495; 254/14, 95, 97; 81/56, 429, 467

[56] References Cited

U.S. PATENT DOCUMENTS

| | | | |
|---|---|---|---|
| 1,179,475 | 4/1916 | Thomas | 105/29.1 |
| 2,845,878 | 8/1958 | Gutridge | 410/61 |
| 2,846,172 | 8/1958 | Gutridge et al. | 410/64 |
| 2,864,321 | 12/1958 | Clejan | 410/57 |
| 2,903,977 | 9/1959 | Winski | 414/333 |
| 3,180,282 | 4/1965 | Gutridge et al. | 410/61 |
| 3,189,307 | 6/1965 | Peterson | 410/61 |
| 3,202,390 | 8/1965 | Sherrie et al. | 410/63 |
| 3,239,962 | 3/1966 | Toteff et al. | 104/140 |
| 3,289,987 | 12/1966 | Candlin, Jr. et al. | 410/61 |
| 3,291,074 | 12/1966 | Remy et al. | 410/61 |
| 3,942,398 | 3/1976 | Fletcher et al. | 81/56 |
| 4,191,107 | 3/1980 | Ferris et al. | 105/4.1 |

*Primary Examiner*—Robert B. Reeves
*Assistant Examiner*—Thomas W. Kearns
*Attorney, Agent, or Firm*—Barnes & Thornburg

[57] ABSTRACT

A collapsible, self-propelled stanchion having a pair of struts pivotally connected at a king pin mating element and wheels at their other end. A motive and propulsion system interconnects the wheeled ends to raise and lower the stanchion as well as propelling the stanchion along the deck of the railroad car using an internal or external source of rotation.

15 Claims, 12 Drawing Figures

STANCHION

BACKGROUND AND SUMMARY OF THE INVENTION

The present invention relates generally to supports for trailers on railroad cars and more specifically to an improved stanchion to support trailers on a railroad car.

It is well known to transport trailers of trucks on railroad cars, namely, flat bed railroad cars. Some designs have used specialized structure railroad cars and adaptors for the landing gear of semi-trailer trucks as illustrated in U.S. Pat. No. 2,864,321. Others have provided stands for the king pin of the trailer which ride along a pair of slots in the surface of the railroad car. An example of these structures are shown in U.S. Pat. Nos. 2,845,878 and 2,903,977. Collapsible fifth wheel stands have also been installed at one end of a flat bed and arranged to be raised beneath a parked trailer to secure it to the railroad car. This is shown in U.S. Pat. No. 3,202,390.

All of the systems of the systems of the prior art have advantages and disadvantages. Those which use specialized car design are not usable to transport other types of freight. Those which have erect stands are not as storable and require the removal of unused stands at one location and a supply at the unloading location if there is further loading to be performed. The collapsible stands are not adjustable along the surface of the flat bed and, thus, do not allow for optimum placement of the maximum number of trailers on a train system. The positioning and securing of the stanchions require special equipment or more than one operator.

Thus, it is an object of the present invention to provide an improved stanchion for mounting trailers to a flat bed.

Another object of the present invention is to provide a collapsible stanchion for a flat bed which is adjustable along the length of the railroad car.

Still another object of the present invention is to provide a self-propelled stanchion which can be moved longitudinally as well as raised and lowered.

These and other objects of the invention are attained by providing a stanchion with first and second struts pivotally connected to a king pin mating element at one end and wheels at the other end of the struts. A motive assembly interconnects at the wheel ends of the first and second struts and move them relative to each other to raise and lower the mating element. A propulsion system is provided to move the stanchion on the surface of a railroad car. A longitudinal channel is provided in the surface of the railroad car in which the wheels move. The motive assembly includes a threaded member and a screw which are rotated relative to each other so as to move the wheeled ends relative to each other. A single electrical motor includes a pair of clutches to interconnect the motor to the motive assembly and the propulsion system and are individually controlled to either propel or raise and lower the stanchion. A rack is provided in the channel and a pinion is provided on wheeled ends of the struts to propel the strut along the surface of the car. The transmission or clutches are braking clutches which lock the propulsion system or the motive assembly when deactivated. Electrical energy mounted in the car is connected to a conductor strip in the channel and provides the power to the electric motor.

Other objects, advantages and novel features of the present invention will become apparent from the following detailed description of the invention when considered in conjunction with the accompanying drawings.

DETAILED DESCRIPTION OF THE DRAWINGS

Figure 1:
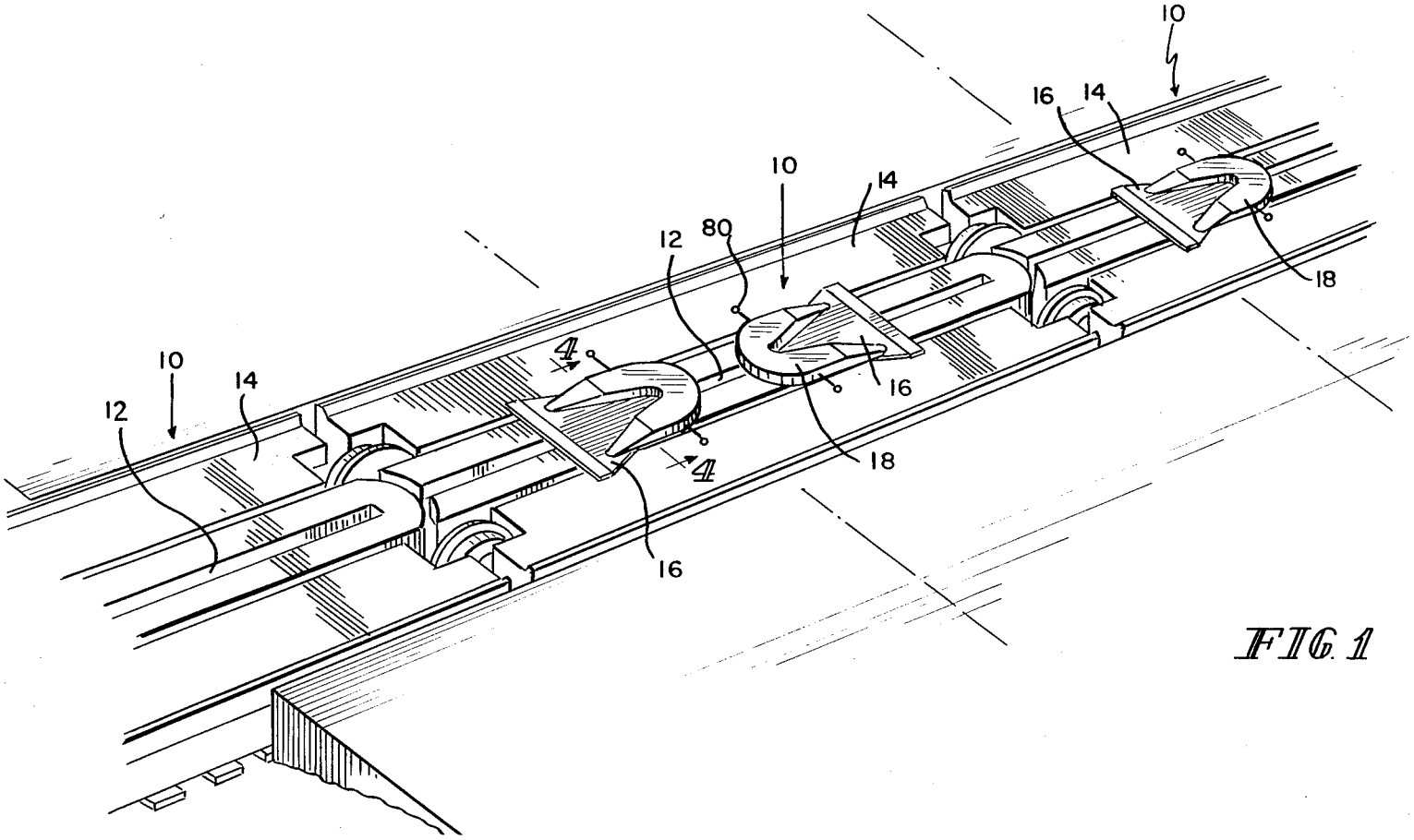
FIG. 1 is a perspective view of a railroad car incorporating the stanchion of the present invention.
Figure 2:
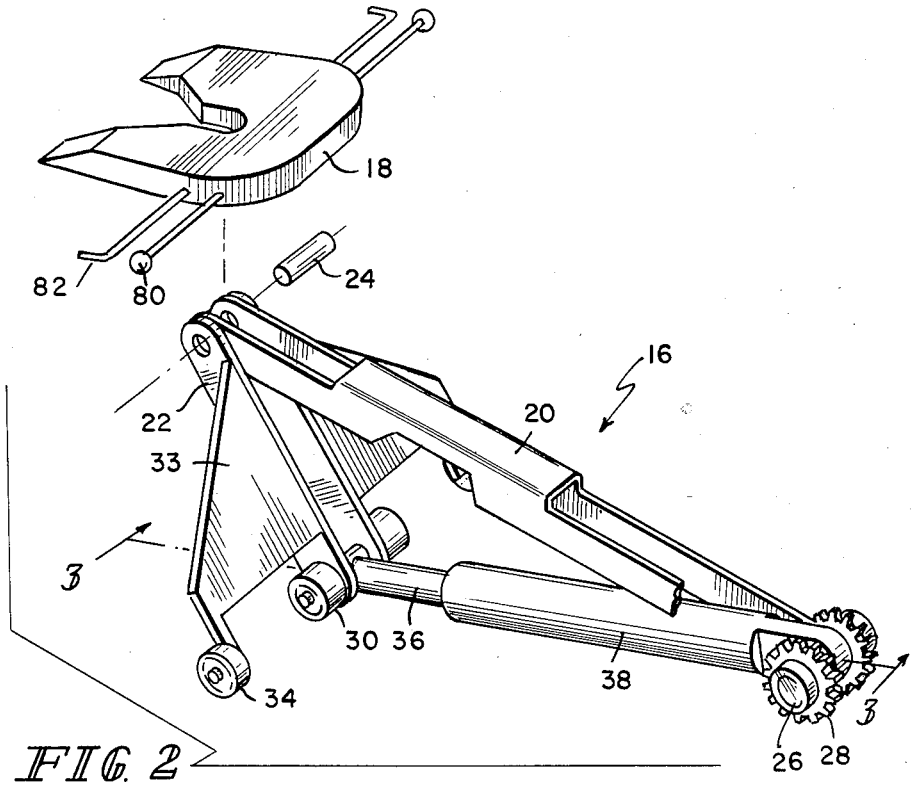
FIG. 2 is a partially exploded perspective view of a stanchion in a partially raised position.

A plurality of railroad cars 10 are shown in FIG. 1 at a siding ready for loading of tractor trailers. A channel 12 runs along the longitudinal axis of the railroad cars in the deck 14. Two oppositely facing stanchions 16 are provided on each car. As illustrated in FIG. 2, the stanchion 16 includes a fifth wheel plate structure 18. A pair of struts 20 and 22 are pivotally connected by pin 24 to the fifth wheel plate structure 18. A pair of wheels 26 and a pair of pinions 28 are provided at the other end of strut 20 and a pair of wheels 30 are provided at the other end of strut 22. A pair of flanges or plates 33 extend laterally from the strut 22 and have wheels 34 at the ends thereof. As also will be explained more fully, the pinions 28 cooperate with the rack in channel 12 to move the stanchions along the length of the railroad cars. This allows maximum flexibility of placement as well as the ability to place the trailers as close as possible to each other. The wheeled ends of struts 20 and 22 are interconnected by telescopic elements 36 and 38. The extension and contraction of the telescopic elements 36 and 38 causes the stanchion to rise and fall respectively. As illustrated in FIG. 1, the stanchions are in their lowermost position allowing trucks, trailers and other elements to be driven thereover. Although wheels 26, 30 and 34 are shown, other friction reducing mechanisms like sliders may be used but are not preferred.

Figure 3:
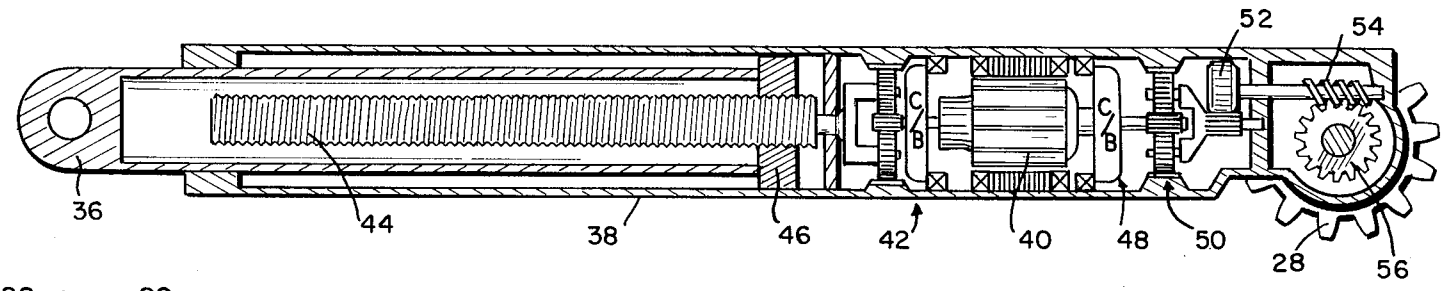
FIG. 3 is a partial cross-sectional view of the stanchion taken along lines 3—3 of FIG. 2.

The power system which enables the stanchion to be raised and lowered as well as to move it along the surface of the railroad car is illustrated specifically in FIG. 3. Electric motor 40, for example a DC motor, is mounted within element 38. An electric clutch 42 interconnects the motor 40 and a screw 44. A threaded element 46 is mounted to the end of telescopic element 36.

As the motor turns screw 44, the threaded element 46 and telescopic element 36 are moved relative to telescopic element 38. A second electrical control clutch 48 connects the motor 40 to planetary reducer 50, gear train 52, worm gear 54 and gear 56 to drive pinion 28. The clutches are brake clutches, namely, they prevent rotation of the output structure when disengaged. This, along with the fact that both the elevating screw and the drive worm are self locking, will maintain the stanchion in the raised position so as to support the load as well as using the pinions to lock the stanchion in place on the surface of the railroad car.

Figure 4:
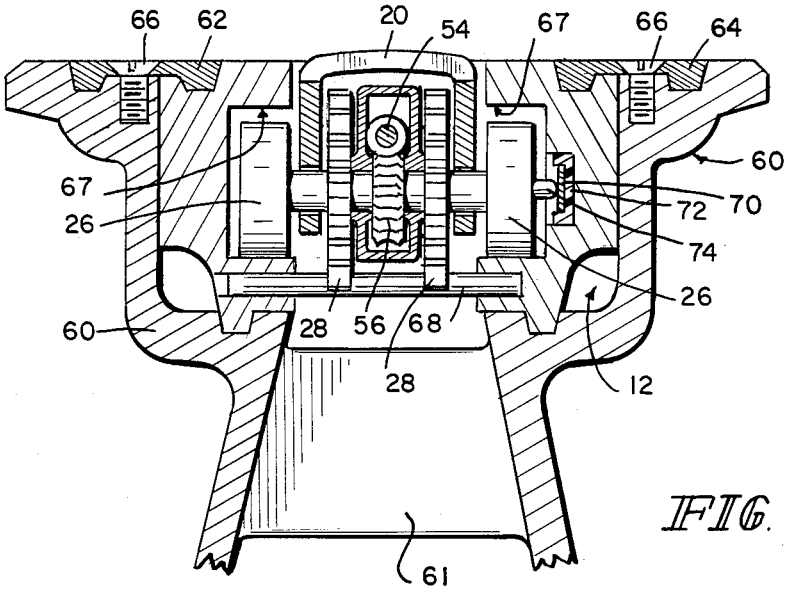
FIG. 4 is a cross-sectional view taken along lines 4—4 of FIG. 1.

The structure of channel 12 is illustrated specifically in FIG. 4 as being formed from a pair of castings or extrusions 60 interconnected by welded ribs 61. A pair of rails 62 and 64 lie within the extrusions 60 and are secured thereto by fastener 66. Each rail 62, 64 includes a race 67 to receive the wheels 26 and 30 of the stanchion. Extending between the opposed rails 62 and 64 are a plurality of spaced pins 68 which form in total a rack to cooperate with pinion 28 to form a rack and pinion drive. By providing wheels 26 with pinion 28 on the same axle, the weight of the stanchion can be carried by the wheels instead of the pinion and therefore reduce the wear on the rack and pinion and require less torque from the motor. A power rail 70 lies in the face of rail 64 and is separated therefrom by an insulator 72. The power rail runs the extent of the channel and is connected to a source of electrical power either on the car or provided to the car through the train system. A power pickup 74 extends from the wheel 26 and is connected to the motor 40 and the control circuit for the motor. The power rail is preferably made of stainless steel, the power pickup 74 is preferably made of German silver and is spring loaded so it contact with the power rail 70. In operation, current would flow from the source through the power rail and pickup, then through appropriate control circuits to ground and through the motor to ground in parallel with the control circuits.

Figure 12:
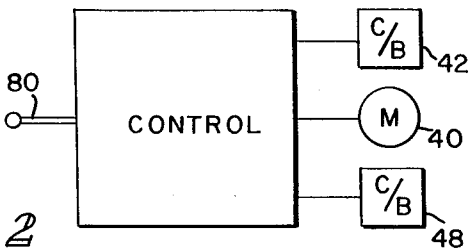
FIG. 12 is a schematic view of the electrical connection of the control bar to the electric clutch/brakes and motor.

A control bar 80 and king pin lock rod 82 are illustrated in FIGS. 1 and 2 as being connected to the fifth wheel plate structure 18. The control bar 80 is a four positioned joy stick which allows raising and lowering as well as forward and reverse movement of the stanchion as illustrated in FIG. 12. Depending upon the position of the control bar 80, electric clutch 40 or 48 will be activated and the motor 40 will be driven in the forward or reverse direction.

Figure 5:
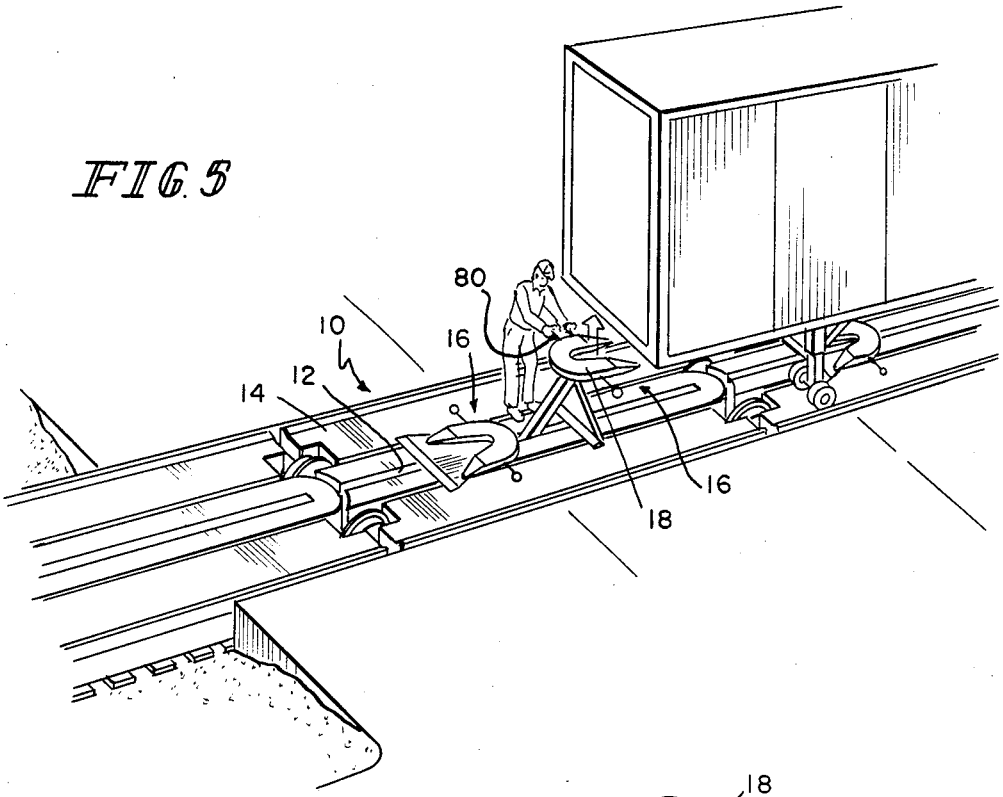
FIG. 5 is a perspective view of an operator manipulating the stanchion of the present invention.

In operation, the train is ready for loading as illustrated in FIG. 1 with the stanchions 16 collapsed onto the deck. The driver drives the trailer onto a car 10 and parks it thereon. The landing gear is dropped and the tractor is removed. The powered stanchion nearest to the king pin of the trailer will be partially raised as illustrated in FIG. 5 by using the control bar 18. The stanchions 16 is then moved towards the trailer and engaging and locking the king pin. Finally, the stanchion is further raised to its uppermost position to raise the trailer and its landing gear clear of the deck. By providing a pair of oppositely facing stanchions 16 on each car, the tractor trailer can extend over the coupling of the cars and be secured thereto by the stanchion which is closest. This allows a closer parking and security of the trailers to the car. This reduces the aerodynamic drag as well as allowing carrying more load.

Figure 6:
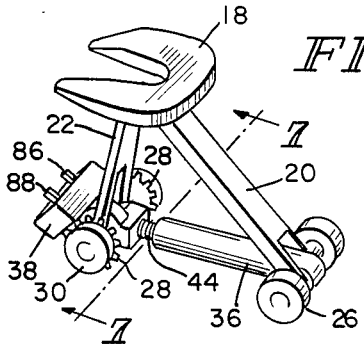
FIG. 6 is a perspective of another embodiment of the stanchion in a raised position.

Another embodiment of the stanchion is illustrated in FIGS. 6–9. All the elements which operate in a similar manner to the previous embodiment include the same numbers. The pair of struts 20 and 22 are pivotably connected to the fifth wheel plate structure 18. A pair of wheels 26 provided at the other end of strut 20 and a pair of pinions 28 and a pair of wheels 30 are provided at the other end of strut 22. The wheeled end of struts 20, 22 are interconnected by telescopic elements 36 and 38. The extension and contraction of telescopic elements 36 and 38 cause the stanchion to fall and rise respectfully. This is the opposite relationship to the previous embodiment. In the embodiment of FIG. 6, the distance between the wheels 26 and 30 is shorter than the distance between the wheels 26 and 30 in FIG. 2 in the raised position. This allows the oppositely facing stanchions in a common car to be placed closer together and thus increase the packing and reduce the aerodynamic drag.

Figure 8:
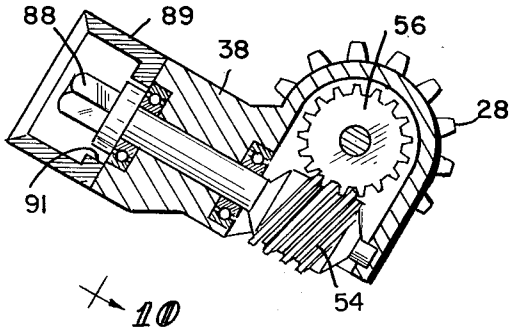
FIG. 8 is a cross-sectional view taken along lines 8—8 of FIG. 7.
Figure 9:
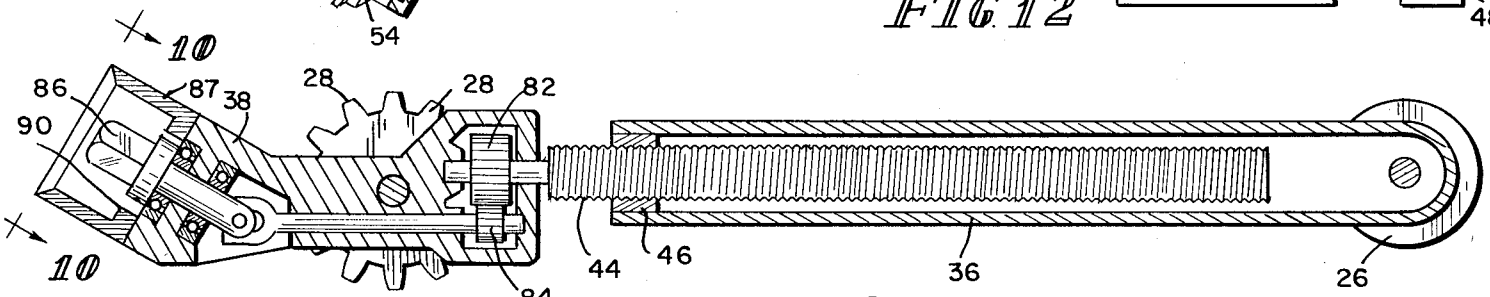
FIG. 9 is a cross-sectional view taken along lines 9—9 of FIG. 7.

The power system for the stanchion of FIG. 6 includes the screw 44 in element 38 and received in a thread element 46 in the telescopic element 36 a shown in FIG. 9. A gear 82 is provided on the end of the screw 44 and is connected by a smaller gear 84 to an input 86 external the element 38. An external source of rotation, for example an electric drill or a mechanical system, is connected via input 86 to drive the screw 44 through gears 82 and 84. If an electric drill is used, the gear 84 is smaller than the gear 82 to provide a reduction. The pinions 28 are connected to a gear 56 and worm gear 54 as shown in FIG. 8. An external input 88 is provided to worm gear 54. As with the input 86, a source of rotations is received via input 88.

Figure 10:
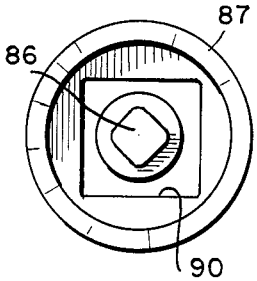
FIG. 10 is a plan view taken along lines 10—10 of FIG. 9.
Figure 11:
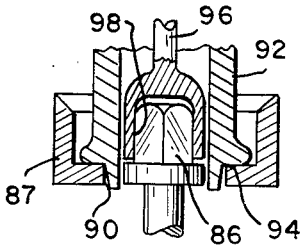
FIG. 11 is a cross-sectional view of an external power source mating with an input.
Figure 7:
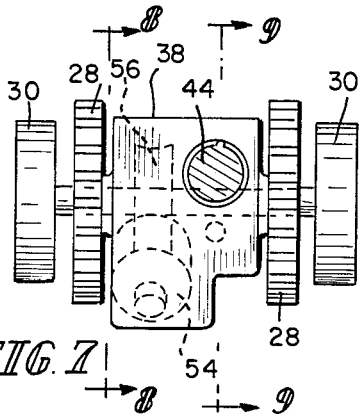
FIG. 7 is a cross-sectional view of the stanchion taken along lines 7—7 of FIG. 6.

A reaction collar 87 and 89 are provided about inputs 86 and 87 respectively. The reaction motion collars 87 and 89 include a rectangular shoulder 90 and 91 respectively. This is shown specifically for input 86 and reaction collar 87 in FIG. 10. An external power source having a housing 92 with external rectangular surfaces 94 and control drive shaft 96 mates with the input 86 and reaction collar 87 as shown in FIG. 11. The drive shaft 96 includes a socket 98 to receive input 86. The faces 94 of the power source housing 92 mate with shoulders 90 of the reaction collar 87. This permits the reaction torque of the power source to be absorbed by the car, rather than through the body of the human operator. This increases operator safety and permits the use of higher torque than an operator could withstand without torque transmission to the car.

In addition to reducing the cost of the stanchion by having a removable power system, this configuration of the stanchion also increases the reliability since there are a fewer parts to be maintained. The operation of the stanchion of FIG. 6 is the same as that described from the previous embodiment, except that the control bar 80 is not provided and the raising or lowering and horizontal movement of the stanchion is produced by connecting the external source of rotation to the individual inputs 86 and 88.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A stanchion for a trailer to be transported on a railroad car comprising:

mating means for mating with a king pin of a trailer;

first and second strut means pivotally connected to said mating means at a first end and surface engaging means mounted on a second;

motive means interconnecting said second ends of said first and second strut means for moving said second end of said second strut means relative to said second end of said first strut means to raise and lower said mating means; and propulsion means connected to said engaging means on said first strut means for driving said engaging means on said first strut means to move said stanchion along a surface of a railroad car when activated and for maintaining said second end of said first strut means stationary when deactivated.

2. A stanchion as defined in claim 1, wherein said motive means includes a threaded member connected to said first strut means, a screw member in said threaded member and connected to said second strut means.

3. A stanchion as defined in claim 2, wherein said motive means includes an electric motor mounted on said stanchion for rotating said screw member relative to said threaded member to move said second ends of said first and second strut means relative to each other.

4. A stanchion as defined in claim 2, wherein said motive means includes first transmission means for connecting an external source of rotation to and rotating said screw member relative to said threaded member to move said second ends of said first and second strut means relative to each other.

5. A stanchion as defined in claim 1, wherein said motive means includes a first transmission means for connecting an external source of rotation to and moving said second ends of said first and second strut means relative to each other and said propulsion means includes second transmission means for connecting an external source of rotation to and driving said wheels.

6. A stanchion as defined in claim 1, wherein said engaging means on said first strut means are high friction elements and said engaging means on said second strut means are low friction elements.

7. A stanchion as defined in claim 6, wherein said high friction elements are pinion gears and said low friction elements are wheels.

8. A stanchion for a trailer to be transported on a railroad car comprising:

mating means for mating with a king pin of a trailer;

first and second strut means pivotally connected to said mating means at a first end and surface engaging means, including wheels on said first strut means mounted on a second end;

motive means interconnecting said second ends of said first and second strut means for moving said second end of said first and second strut means relative to each other to raise and lower said mating means;

propulsion means connected to said wheels on said first strut means for driving said wheels to move said stanchion along a surface of a railroad car;

an electric motor;

first transmission means for connecting said electric motor to said motive means;

second transmission means for connecting said electric motor to said propulsion means; and control means connected to said first and second transmission means to individually activate said first and second transmission means.

9. A railroad car having a deck, wheels and stanchion combination, including: a longtudinal channel extending along the length of said deck; and said stanchion comprising:

mating means for mating with a trailer;

first and second strut means pivotally connected to said mating means at a first end and surface engaging means at a second end, said surface engaging means includes wheels for said first strut means that ride in said channel;

motive means interconnecting said second end of said first and second strut means for moving said second end of said first and second strut means relative to each other to raise and lower said mating means;

propulsion means connected to said wheels on said first strut means for driving said wheels to move said stanchion along said channel;

an electric motor;

first transmission means for connecting said electric motor to said motive means;

second transmission means for connecting said electric motor to said propulsion means; and control means connected to said first and second transmission means to individually activate said first and second transmission means.

10. A combination as defined in claim 9, wherein said motive means includes a threaded member connected to said first strut means, a screw member in said threaded member and connected to said second strut means.

11. A combination as defined in claim 9, including a rack in said channel and said propulsion means includes, on said first strut means, pinions to ride on said rack.

12. A combination as defined in claim 9, wherein said first and second transmission means includes braking clutches which lock when deactivated.

13. A combination as defined in claim 9, including a source of electrical energy on said car, a conductive strip in said channel and connected to said source, and means for connecting said electric motor and said conductive strip.

14. A stanchion as defined in claim 9, including reactions means at said first and second transmission means for absorbing and transmitting reaction force from an external source of rotation to said stanchion.

15. A combination as defined in claim 9, wherein said mating means, first and second strut means and motive means form a first stanchion and including a second stanchion on said car having the same structure as said first stanchion.

* * * * *